US007327979B2

(12) United States Patent
Katayanagi

(10) Patent No.: US 7,327,979 B2
(45) Date of Patent: Feb. 5, 2008

(54) IMAGE FORMING APPARATUS

(75) Inventor: Hidetoshi Katayanagi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/132,408

(22) Filed: May 19, 2005

(65) Prior Publication Data

US 2006/0067753 A1 Mar. 30, 2006

(30) Foreign Application Priority Data

Sep. 30, 2004 (JP) ..... 2004-286657

(51) Int. Cl.
*G03G 15/20* (2006.01)

(52) U.S. Cl. ..... 399/329

(58) Field of Classification Search ..... 399/329, 399/328

See application file for complete search history.

(56) References Cited

U.S. PATENT DOCUMENTS 5,210,580 A * 5/1993 Aslam et al. ..... 399/328
5,309,210 A * 5/1994 Yamamoto et al. ..... 399/329
5,359,401 A * 10/1994 Uehara et al. ..... 399/67
6,026,274 A * 2/2000 Aslam et al. ..... 399/329
2004/0037596 A1 2/2004 Nakamura et al.
2005/0008408 A1* 1/2005 Inomata ..... 399/323
2005/0163543 A1* 7/2005 Satoh et al. ..... 399/329

FOREIGN PATENT DOCUMENTS

JP 5-150679 6/1993
JP 2006242980 A * 9/2006

* cited by examiner

*Primary Examiner*—Quana Grainger
(74) *Attorney, Agent, or Firm*—Finnegan, Henderson, Farabow, Garrett & Dunner, L.L.P.

(57) ABSTRACT

An image forming apparatus includes: a heating unit; a pressure roller; a separation roller whose diameter is smaller than the pressure roller's one; a belt which connects the pressure roller and the separation roller to form a pressure unit, wherein the pressure roller presses the heating unit through the belt to fix a toner image on a sheet of paper passing through a nip between the heating unit and the pressure unit, wherein the separation roller is located such that a direction of the belt from the pressure roller to the separation roller coincides with a tangent to an imaginary circle which the pressure roller forms at the nip or is on a pressure roller side with respect to the tangent.

13 Claims, 5 Drawing Sheets

IMAGE FORMING APPARATUS

BACKGROUND OF THE INVENTION

1. Field of the Invention

The present invention relates to an image forming apparatus comprising a heat fixing device used for electrophotography, such as a copier, a printer and a FAX. More particularly, the present invention relates to an image forming apparatus comprising a heat fixing device using a belt.

2. Description of Related Art

In a fixing device of electrophotography, a transfer medium supporting a toner image is passed through a nip portion that is formed simply by pressing two rollers and toner is fixed on the transfer media (9MA, 9MB and 9MC). As an earlier example, a device in which at least one of the two rotators is replaced by a belt is also developed.

FIGS. 4A to 4D are views showing outlines of fixing devices using a belt.

However, when the diameters of the two rollers forming a nip is made large in order to gain a nip portion 9NA width as shown in FIG. 4A, the curvatures of the two rotators become small at the transfer medium outlet of the nip portion 9NA and a problem that the transfer medium 9MA cannot be separated from the heating belt 9BA occurs. Accordingly, there is a limitation of accelerating the fixing process. On the other hand, fixing performance and separation performance are ensured in a technique that two or more rollers are provided inside the heating belt 9BB and a roller having a small diameter which contacts with the inside of the heating belt 9BB is provided at the downstream area of the nip portion 9NB to ensure the separation performance, as shown in FIG. 4B. However, there is problem that an area f where the heating belt 9BB is not supported by a roller is necessarily formed and image shift is caused. As above, in cases that the separation points of a transfer medium from two rotators are the same position, there is limitation on acceleration of the fixing process.

FIG. 4C shows a development in which the separation points of a transfer medium from two rotators are made different in order to solve the above problem.

In the development, a transfer medium 9MC is separated from a heating belt 9BC at the position of the maximum curvature of a separation roller 9SC for stretching the heating belt 9BC at the downstream in the paper feeding direction from a main nip portion e.

However, when melting of toner in the main nip portion is not maintained with much accuracy, uneven brightness occurs owing to unstable contact between the belt and the transfer medium.

Further, there is proposed a development that, for example, an elastic heat fixing roller 9FD is brought into contact with a pressure roller 9PD through the heat-resistant belt 9BD by pressurization, the heat fixing roller 9FD is distorted and the amount of the distortion is regulated not less than a predetermined value, and thereby a problem such as unevenness of image in separating the transfer medium is solved, as shown in FIG. 4D (JP Tokukaihei-5-150679A).

In recent years, the demands for duplex have increased, while it is necessary to separate a transfer medium having a fixing-completion toner image on one face and a not-fixed toner image on the other face after the transfer medium passes through the nip portion.

However, nothing about the separation performance in duplexing is described in the development shown in FIG. 4D.

SUMMARY OF THE INVENTION

The present invention is achieved in consideration of the above situation, and has an object of providing an image forming apparatus ensuring fixing performance and transfer medium separation performance. Furthermore, an object is to provide an image forming apparatus having a fixing device that ensures fixing performance and transfer medium separation performance and is capable of preventing uneven brightness.

To solve the above problem, in accordance with the first aspect of the invention, an image forming apparatus comprises: a heating unit; a pressure roller; a separation roller whose diameter is smaller than the pressure roller's one; a belt which connects the pressure roller and the separation roller to form a pressure unit, wherein the pressure roller presses the heating unit through the belt to fix a toner image on a sheet of paper passing through a nip between the heating unit and the pressure unit, wherein the separation roller is located such that a direction of the belt from the pressure roller to the separation roller coincides with a tangent to an imaginary circle which the pressure roller forms at the nip or is on a pressure roller side with respect to the tangent.

In accordance with the second aspect of the invention, An image forming apparatus comprises: a heating unit; a pressure roller; a separation roller whose diameter is smaller than the pressure roller's one; a belt which connects the pressure roller and the separation roller to form a pressure unit, wherein the pressure roller presses the heating unit through the belt to fix a toner image on a sheet of paper passing through a nip between the heating unit and the pressure unit, wherein the separation roller is located such that a direction of the belt from the pressure roller to the separation roller is on a pressure roller side with respect to an imaginary line formed by connecting an inlet and an outlet of the nip.

In accordance with the third aspect of the invention, an image forming apparatus comprises: a heating unit; a pressure roller; a separation roller whose diameter is smaller than the pressure roller's one; a belt which connects the pressure roller and the separation roller to form a pressure unit, wherein the pressure roller presses the heating unit through the belt to fix a toner image on a sheet of paper passing through a nip between the heating unit and the pressure unit, wherein the separation roller is located such that a direction of the belt from the pressure roller to the separation roller is on a pressure roller side with respect to a progression direction of a sheet of tough paper immediately after the paper passes the nip.

According to the first, second and third aspects of the invention, it is possible to prevent sticking and uneven brightness, and to provide an image forming apparatus ensuring fixing performance and transfer medium separation performance.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENTS OF THE INVENTION

As for description in the embodiment of the present invention, the scope of the art of the present invention is not limited by terms used in the present specification.

At first, a fixing device, which is an example of the present invention, and an image forming apparatus comprising the same will be described.

Figure 1:
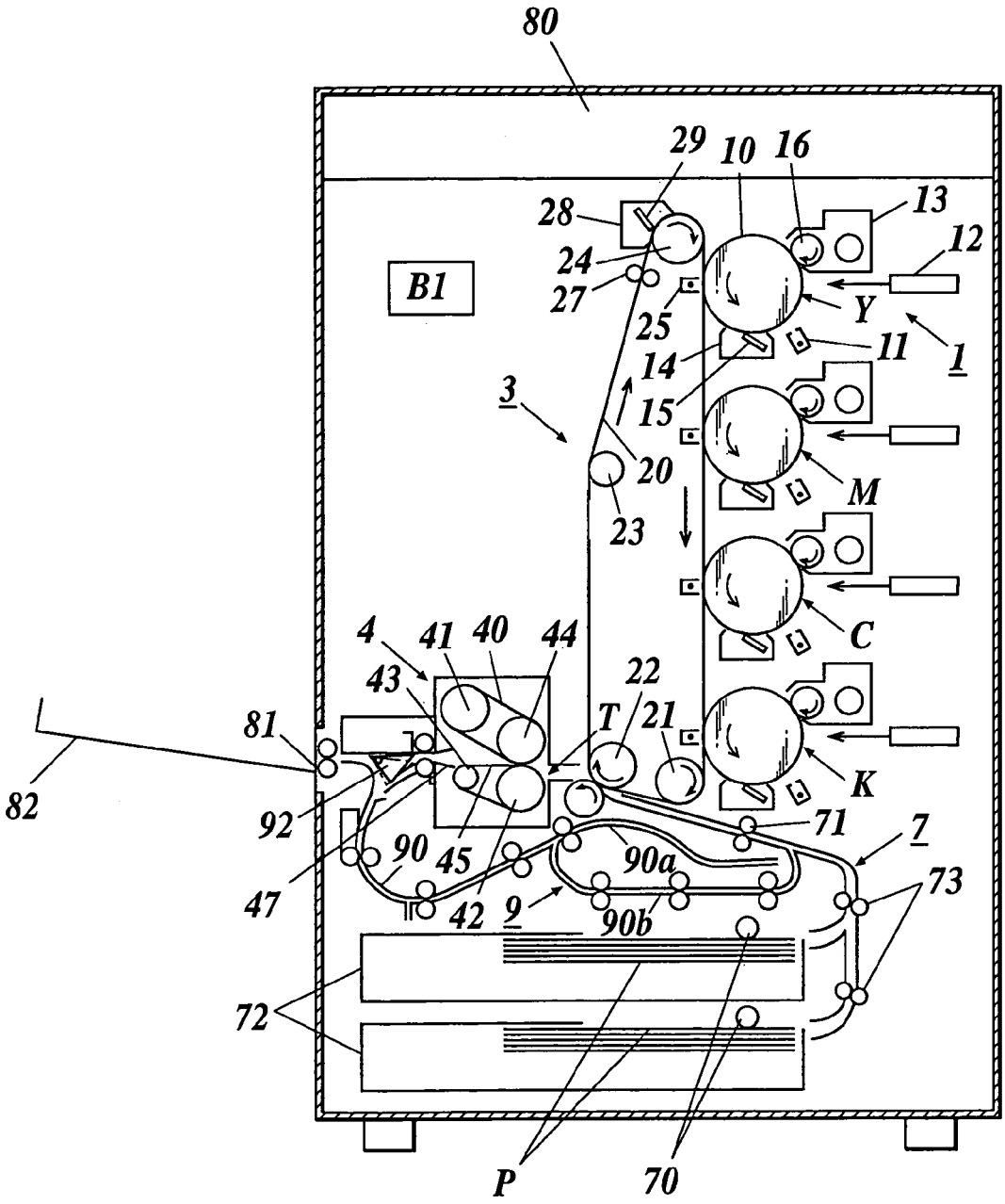
FIG. 1 is an image recording apparatus having a complex function using a digital method.

FIG. 1 is a schematic view showing an example of the entire structure of an image forming apparatus.

In FIG. 1, numerical reference 10 denotes a photoconductor, 11 denotes a scorotron charging member which is a charging unit, 12 denotes a writing device which is an image writing unit, 13 denotes a developing member which is a developing unit, 14 denotes a cleaning device for cleaning the surface of the photoconductor 10, 15 denotes a cleaning blade, 16 denotes a developing sleeve, and 20 denotes an intermediate transfer belt. An image forming unit 1 comprises the photoconductor 10, the scorotron charging member 11, the developing member 13, the cleaning device 14 and the like. An image forming unit 1 for each color has the same mechanical structure. Accordingly, in FIG. 1, reference characters are appended to components of Y (yellow) series. As for components of M (magenta), C (cyan) and K (black), reference characters are omitted.

The arrangement of the image forming apparatuses 1 for the colors is the order of Y, M, C and K in the running direction of the intermediate transfer belt 20. Each photoconductor 10 contacts with the stretched surface of the intermediate transfer belt 20 and rotates at the contact point in the same direction as the running direction of the intermediate transfer belt 20 and at the same linear speed as the intermediate transfer belt 20.

The intermediate transfer belt 20 is stretched across a driving roller 21, an earth roller 22, a tension roller 23, a neutralization roller 27 and a driven roller 24. A belt unit 3 is constituted of these rollers, the intermediate transfer belt 20, a transfer member 25, a cleaning device 28 and the like.

The run of the intermediate transfer belt 20 is performed by rotation of the driving roller 21 owing to a not shown driving motor.

The photoconductor 10 is, for example, a cylindrical metal substrate formed of aluminum, and a conductive layer, an a-Si layer or a photosensitive layer such as organic photoconductor (OPC) is formed on the periphery of the cylindrical substrate. The photoconductor 10 rotates counterclockwise shown by the arrow in FIG. 1 with the conductive layer earthed.

An electric signal corresponding to image data from the reading device 80 is converted into an optical signal to be projected onto the photoconductor 10 by the writing device 12.

The developing member 13 has a predetermined distance to the peripheral surface of the photoconductor 10 and comprises the developing sleeve 16 that is formed of cylindrical non-magnetic ceramics or aluminum rotating in the same direction as the rotation direction of the photoconductor 10 at the closest position.

The intermediate transfer belt 20 is an endless belt having a volume resistivity of $10^6$ to $10^{12}$ Ω·cm, and for example, a semiconductive seamless belt having a thickness of 0.04 to 0.10 mm in which conductive material is dispersed in engineering plastic such as modified polyimide, thermosetting polyimide, ethylene tetrafluoroethylene copolymer, polyfluorovinylidene, nylon alloy and the like.

Numerical reference 25 denotes a transfer member. Current having an opposite polarity to toner is applied to the transfer member 25. The transfer member 25 has a function for transferring a toner image formed on the photoconductor 10 onto the intermediate transfer belt 20. As the transfer member 25, a transfer roller can be used besides a corona discharge member.

Numerical reference 26 denotes a transfer roller capable of contacting with and separating from the earth roller 22. The transfer roller 26 retransfers the toner image formed on the intermediate transfer belt 20 to a transfer medium P.

Numerical reference 28 denotes a cleaning device which is provided opposite the driven roller 24 across the intermediate transfer belt 20. After the toner image is transferred to the transfer medium P, residual toner's charge is weakened by a neutralization roller 27 to which alternating voltage superposed by direct current having the same or opposite polarity to toner is applied and toner remaining on the periphery is cleaned by a cleaning blade 29 in the intermediate transfer belt 20.

Numerical reference 7 denotes a feeding unit, 70 denotes paper feed rollers, 71 denotes a timing roller, 72 denotes paper cassettes, 73 denotes feeding rollers, 81 denotes an eject roller, 82 denotes an ejected paper tray, 9 denotes an ADU system, and B1 denotes a controller as a control unit.

Numerical reference 4 denotes a fixing device relating to the present invention, comprising a heating roller 41, a pressure roller 42, a separation roller 43, a fixing roller 44, a heating belt 40 which is an endless belt and a pressure belt 45 which is an endless belt. A nip portion T is formed by bringing the fixing roller 44 and pressure roller 42 into contact with each other through the heating belt 40 and pressure belt 45 with pressurization. The transfer medium P on which an unfixed toner image is formed is passed between the heating belt 40 and the pressure belt 45, and thereby the toner image is melted and fixed on the transfer medium P owing to heating and pressurizing. The transfer medium P having the toner image fixed is separated from the heating belt 40 at the end of the nip portion T, and being attached to the pressure belt 45. In both cases of single-side and double-side printing, self stripping of the transfer medium P from the pressure belt 45 occurs at the separation roller 43, and then the transfer medium P is ejected from the fixing device 4 along the fixing guide 47. Details of the mechanical section of the fixing device 4 will be described later.

When a single-side (front-side) image forming mode is selected in a not shown operation panel, the transfer medium P finishing fixation of the front-side image is proceeded straightly and ejected from the eject roller 81 onto the ejected paper tray 82. In case that a double-side image forming mode is selected, a toner image is also formed on the other side (back-side) according to the process described below. Since toner used here contains wax, releasability from the belt in the fixing process is good. Accordingly, oil coating or the like is not required.

That is, the transfer medium P finishing image fixation of the front side descends along a reverse feeding path 90 of an ADU system that comprises the reverse feeding path 90 having a reverse switching member 92, a switch-back path 90*a*, and a second reverse feeding path 90*b*. Subsequently, the transfer medium P is transported into the switchback path 90*a* and then is transported out to reverse the front side and the back side. Subsequently the transfer medium P is passed through the second reverse feeding path 90*b* and is re-fed along the feeding unit 7. The transfer medium P is suspended by the timing roller 71 for correcting the tilt and deviation of the sheet. Then a toner image of the back-side image formed again on the intermediate transfer belt 20 is transferred to the back side of the transfer medium P by the earth roller 22, followed by separating and transporting the transfer medium P. Subsequently, the transfer medium P undergoes the fixing process and is ejected from the eject roller 81 onto the ejected paper tray 82.

Next, details of the fixing device 4 will be described based on FIG. 2.

Figure 2:
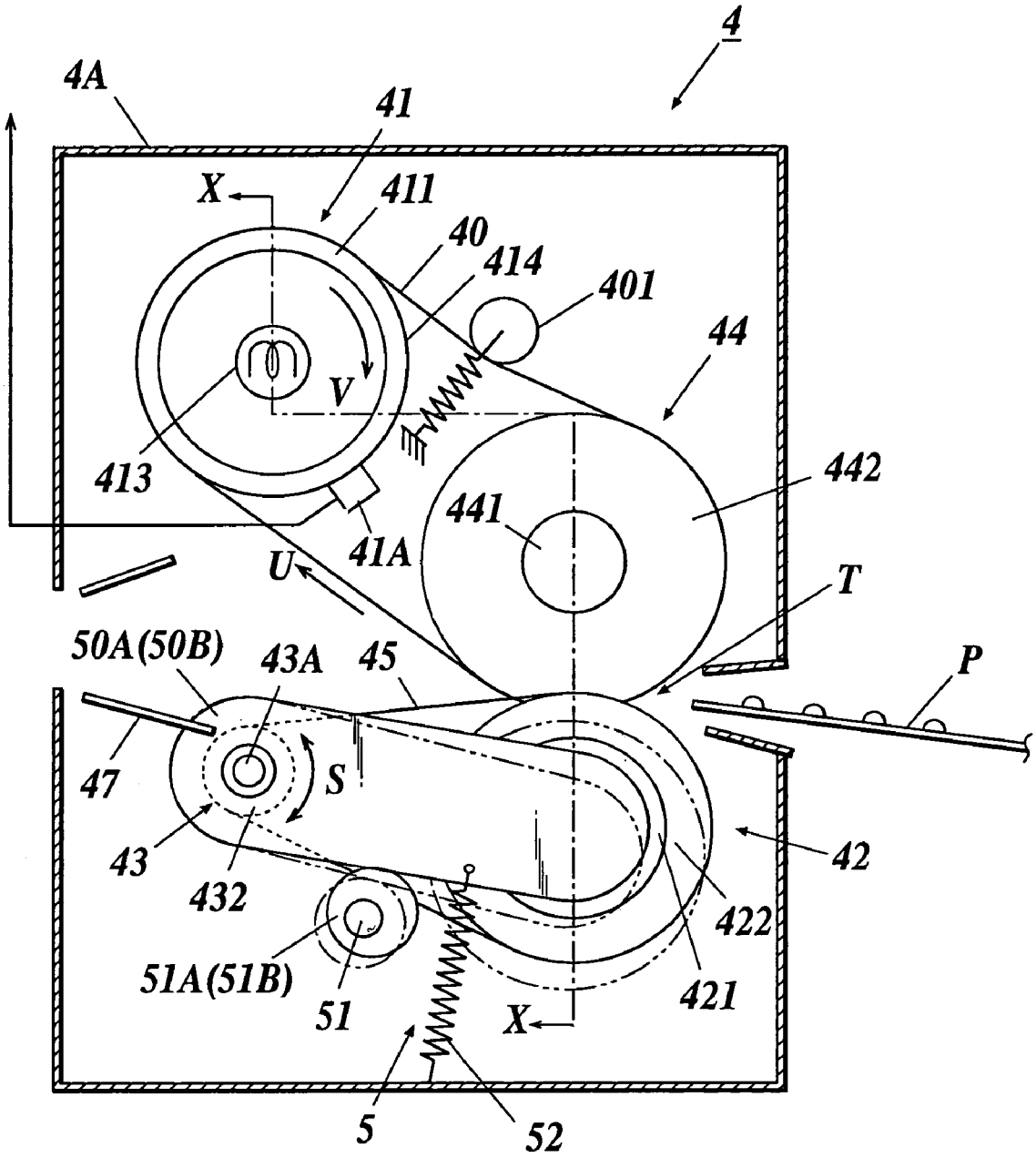
FIG. 2 is an enlarged view of a fixing device in FIG. 1.

FIG. 2 is an enlarged view of a fixing device in FIG. 1.

Figure 3:
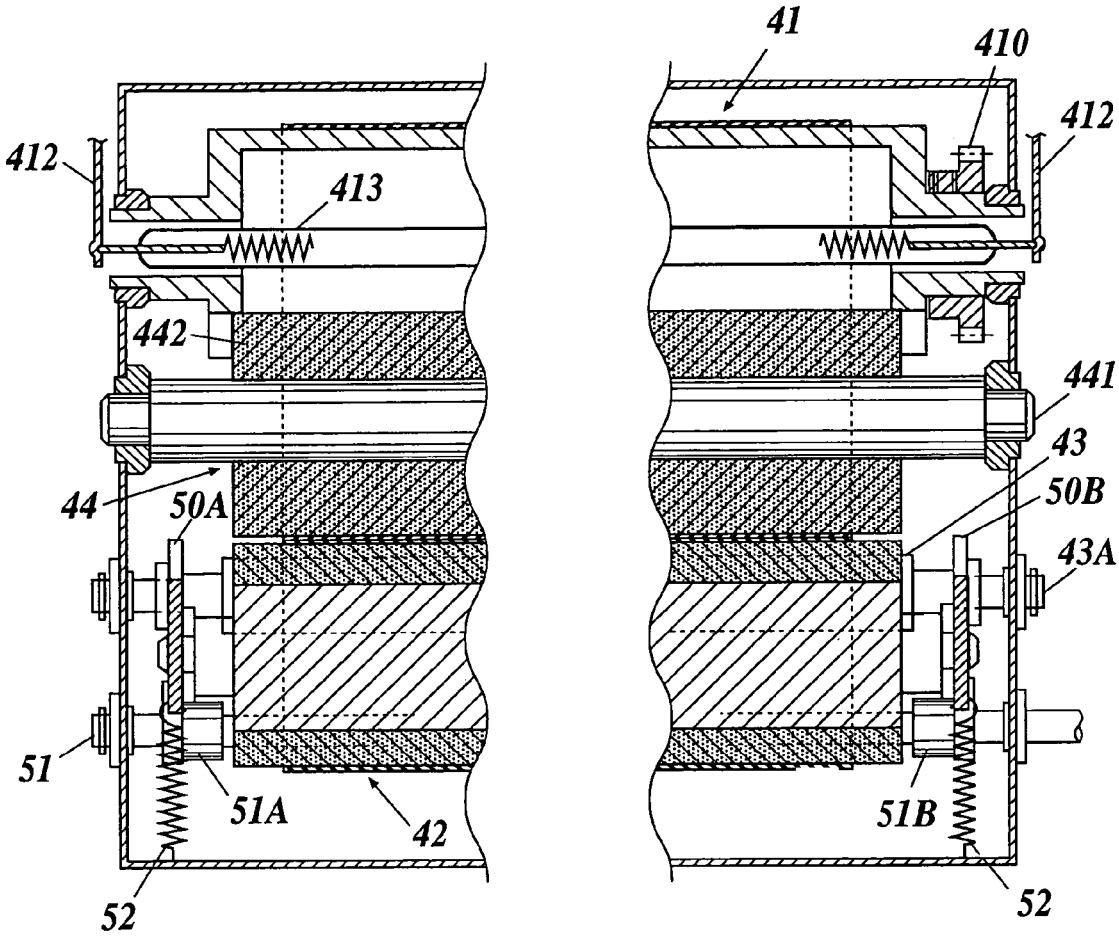
FIG. 3 is a view showing a sectional view on arrow XX in FIG. 2.
Figure 4A:
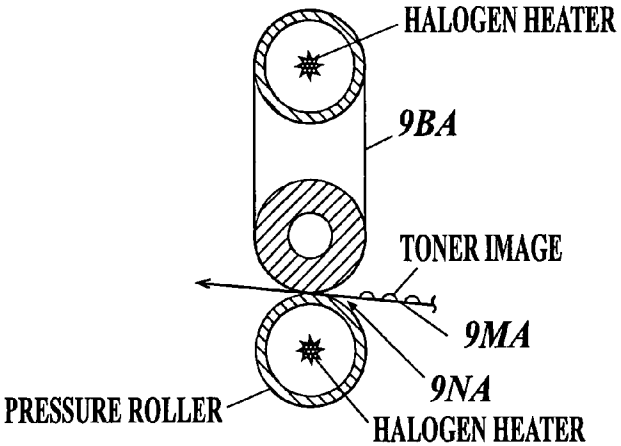
FIG. 4A is a view showing an outline of a fixing device using a belt.
Figure 4B:
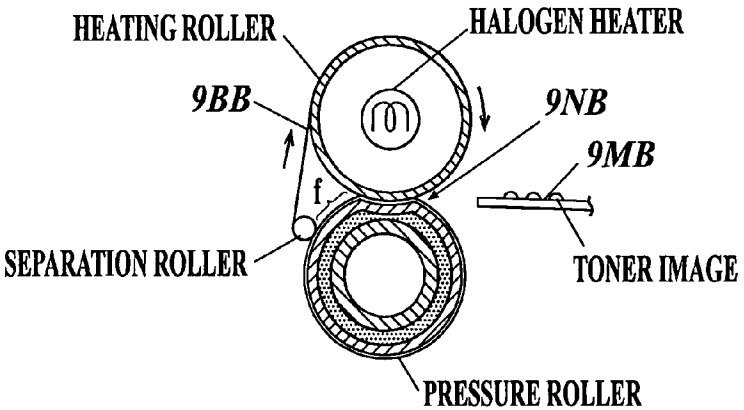
FIG. 4B is a view showing an outline of a fixing device using a belt.
Figure 4C:
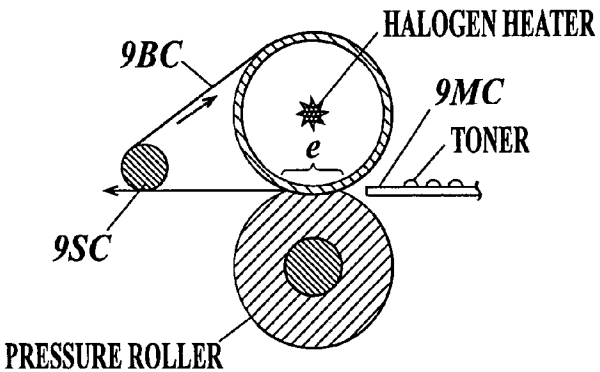
FIG. 4C is a view showing an outline of a fixing device using a belt.
Figure 4D:
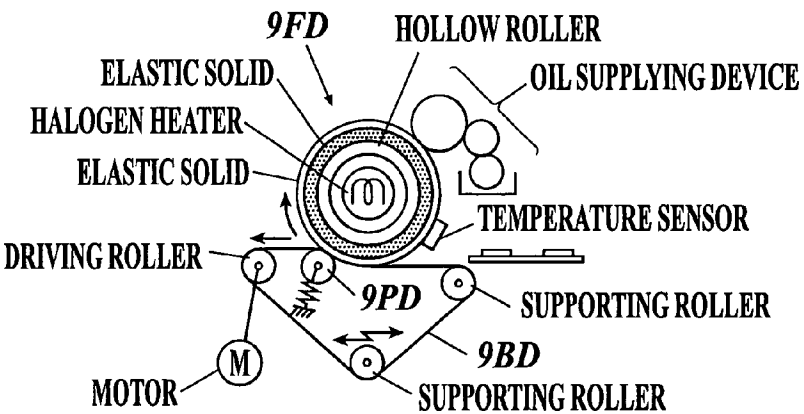
FIG. 4D is a view showing an outline of a fixing device using a belt.

FIG. 3 is a view showing a sectional view on arrow XX in FIG. 2.

In FIGS. 2 and 3, the heating roller 41 is made by coating the periphery of an aluminum cored bar 411 with PFA resin 414. The pressure roller 42 is made by lining the periphery of an iron cored bar 421 with silicone rubber 422 which is an elastic layer and further coating the periphery with PFA resin. The fixing roller 44 is made by lining the periphery of an iron cored bar 441 with silicone sponge 442. The hardness of the fixing roller 44 is configured to be lower than the hardness of the pressure roller 42. Accordingly, in the nip portion T, the shape of the fixing roller 44 becomes concave. Thus, it is possible to expand the nip width and facilitate separation of the transfer medium P from the heating belt 40 on the downstream side of the nip portion T. The separation roller 43 is made by lining an iron cored bar with foamed ceramics 432 and further coating it with PFA resin. The heating belt 40 and the pressure belt 45 are made by lining the outer surfaces of belt substrates with silicone rubber and further applying PFA resin, which has good releasability of toner, thereon.

The heating roller 41 and the fixing roller 44 are supported by the frame 4A of the fixing device 4 through a bearing.

The heating belt 40 is stretched across the heating roller 41 and the fixing roller 44 through a tension roller 401. The heating belt 40 runs in the direction of arrow U along with rotation of the heating roller 41. The heating roller 41 is rotated by a gear 410 integrated with the heating roller 41. The gear 410 engages with a not shown driving gear that obtains mechanical power from a not shown driving source to rotate. In the cavity of the heating roller 41, a halogen heater 413 that is supported by an energizing contact 412 attached to the fixing device frame 4A through an insulating member heats up to a predetermined temperature and gives heat to the heating belt 40 whose temperature is detected by a thermistor sensor 41A which is a temperature sensor of contact located on the surface of the heating roller 41. The temperature is transmitted to the not shown controller. The controller controls the surface temperature of the heating roller 41 to a defined temperature by turning on and off the halogen heater 413.

Numerical reference 5 denotes a pressure unit. The pressure unit 5 comprises the pressure roller 42, the pressure belt 45, supporting plates 50A and 50B, an eccentric cam 51A (51B), a rotation shaft 51, a spring 52 and the like.

The pressure belt 45 is stretched across the pressure roller 42 and the separation roller 43 through a not shown tension roller. The rotation shaft 43A of the separation roller 43 is supported by the frame A of the fixing device 4 through a bearing. The supporting plates 50A and 50B for supporting the pressure roller 42 are inserted through the both ends of the rotation shaft 43A. The supporting plates 50A and 50B are supported by the pressure roller 42 through the bearing. The supporting plates 50A and 50B are integrated by a not shown stay and rotatable around the rotation shaft 43A as a spindle. The supporting plates 50A and 50B engage through the spring 52 with the eccentric cams 51A and 51B that are attached to the rotation shaft 51 in phase. The supporting plates 50A and 50B rotate in the direction of arrow S around a support of the rotation shaft 43A to perform pressurization (contacting by pressure) or release of pressurization (release of contacting by pressure) of the pressure roller 42 to the fixing roller 44. That is, pressurization is performed when a transfer medium supporting a toner image is subjected to the fixing process. Release of pressurization is performed when the fixing process has finished. The rotation shaft 51 obtains rotation power from a not shown driving source at a predetermined timing to rotate.

As described above with reference to FIGS. 4A to 4D, there is limitation on acceleration of the fixing process in the system where separation points of a transfer medium are the same position for two rotators. In a method that a transfer medium is separated in the downstream of a main nip portion and further separated from the heating belt at the position where a separation roller stretching the heat belt in the downstream in the paper feeding direction has the maximum curvature, uneven brightness often occurs because contact of the belt with the transfer medium is unstable when the melting degree of toner fails to be maintained with extremely high accuracy in the main nip portion. The latter method cannot deal with various transfer media, because the contact of the belt with the transfer medium also varies with the weight and the toughness of the transfer medium.

As described above, setting the hardness of the fixing roller 44 lower than the hardness of the pressure roller 42 makes it possible to certainly separate a transfer medium from the heating belt 40 in the nip portion T in a single-side printing, and causes no uneven brightness. After transfer, a transfer medium transported along the pressure belt 45 obtains the separation performance in double-side printing at the position of the separation roller 43 because the curvature of the separation roller 43 is regulated larger than that of the pressure roller 42 (i.e. the diameter of the separation roller is regulated smaller than the diameter of the pressure roller). Therefore self stripping is certainly possible. Preferably, the diameter of the separation roller 43 is 10 to 80% of the diameter of the pressure roller 42 or 5 to 20 mm.

On the other hand, firstly, separation from the pressure belt 45 is ensured in the nip portion T and no uneven brightness is caused, in back-side printing. A transfer medium transported along the pressure belt 45 certainly undergoes self stripping from the pressure roller 42 at the position of the separation roller 43. After the transfer medium P passes through the nip portion T, contact of the transfer medium with the pressure belt 45 is stable to an extent up to the position of the separation roller 43 owing to the weight of the transfer medium, wax and an adhesive force through toner. The state of the contact of the transfer medium with the pressure belt 45 does not change very much even when the toughness is changed by the weight of the transfer medium. Because the toner image contacting with the pressure roller 42 is certainly heated by passing though nip portion T twice and wax as a release agent bleeds out of the inside of toner to the surface, no uneven brightness is caused when the contact with the pressure roller 42 is unstable to the above-described extent.

Hereinbelow, furthermore, separation performance will be described based on FIG. 5.

Figure 5:
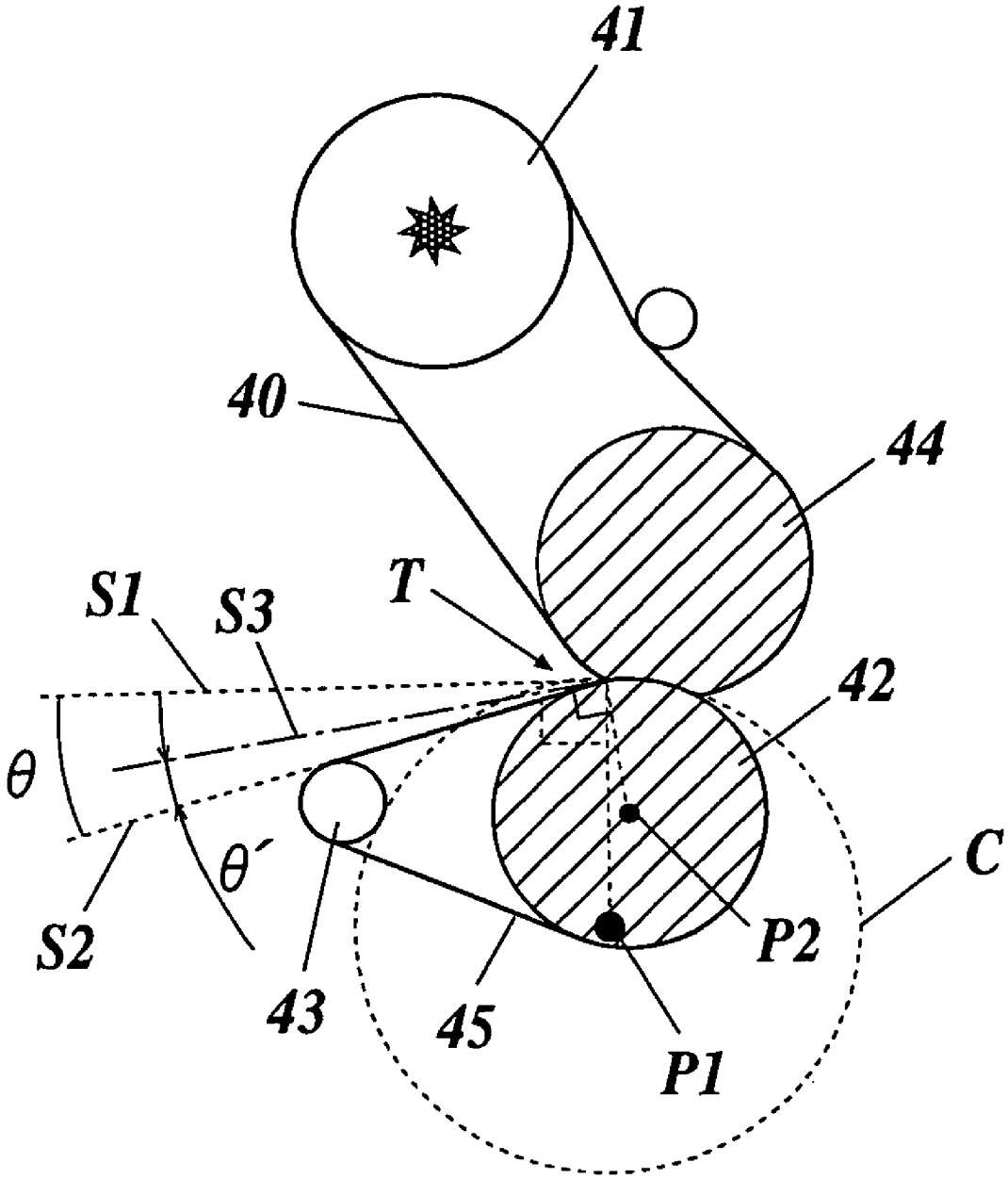
FIG. 5 is a view showing a sectional shape of a nip portion between a pressure roller and a fixing roller in pressed state.

FIG. 5 is a view showing a sectional shape of a nip portion between a pressure roller and a fixing roller in pressed state.

In FIG. 5, the fixing roller 44 and the pressure roller 42 are elastic. In case that the hardness of the fixing roller 44 is lower than the hardness of the pressure roller 42, the sectional shape of the nip portion by contacting two rollers through the heating belt 40 and pressure belt 45 becomes like an imaginary circle C indicated by a dotted line with a center at P1. The sectional shape of the nip portion is different from the peripheral surface at the time that the pressure roller 42 does not contact with the fixing roller 44. In this state, the tangent of the imaginary circle C at the outlet of the nip portion corresponds to S1. In this case, θ is defined as an angle formed by the extension line S2 of the pressure belt 45 (which coincides with the belt line between the pressure roller 42 and the separation roller 43) and the tangent S1.

On the other hand, when it is assumed that the pressure roller 42 is a hard member (non-elastic), the tangent of the pressure roller 42 (with a center of P2) at the outlet of the nip portion corresponds to S3. In this case, θ' is defined as an angle formed by the extension line S2 of the pressure belt 45 and the tangent S3.

Next, the angles θ and θ' were changed by shifting the separation roller 43 up and down and a check experiment about sticking to the fixing roller 44 and uneven brightness was carried out.

In paper feeding, unfixed toner was put on the entire single side of coated paper. The fixing process in which the unfixed toner was brought into contact with the nip portion T was carried out. Consequently, results as shown in Table 1 were obtained.

TABLE 1

| Angle | | Fed transfer medium | |
|---|---|---|---|
| θ | θ' | 81.4 gsm coated paper | 104.7 gsm coated paper |
| Not more than −20° | | Rank 4 | Rank 4 |
| −10° | −15° | Rank 4 | Rank 3 |
| −5° | −10° | Rank 3 | Rank 2 |
| 0° | −5° | Rank 2 | Rank 1 |
| 5° | 0° | Rank 1 | Rank 1 |
| Not less than 5° | | Rank 1 | Rank 1 |

In Table 1, minus (−) expression of angles θ and θ' indicate that the tangents S1 and S3 lie under the extension line S2 by moving the separation roller 43 to the side of the fixing roller 44.
Rank 1: there is no sticking of paper over the fixing belt and there is no image disturbance.
Rank 2: there is no sticking of paper over the fixing belt but slight uneven brightness is observed.
Rank 3: there is no sticking of paper over the fixing belt but a considerable degree of uneven brightness is observed.
Rank 4: there is sticking of paper over the fixing belt to cause jam.

Note that slight uneven brightness of Rank 2 is thought to be caused by a little sticking over the fixing belt, but the level of an image is satisfactory.

Accordingly, in FIG. 5, it was confirmed that sticking and uneven brightness could be prevented when θ and θ' were 0° (the tangent S1 or S3 coinciding with the extension line S2) or more. Therefore, in order to obtain a desired effect, it is sufficient that the separation roller 43 is arranged such that the tangent S1 or S3 coincides with the extension line S2 or lies above the extension line S2.

In the above examples, illustration with the tangent at the outlet of the nip portion to the imaginary circle C was carried out. However, because the progression direction immediately after a sheet of tough paper passes through the nip portion almost coincides with the above-described tangent as well, it is sufficient that the separation roller 43 is arranged by using the progression direction as a parameter. That is, in this case, the separation roller 43 is arranged such that the progression direction of a sheet coincides with the extension line S2 or lies above the extension line S2.

Furthermore, it is possible to obtain a similar effect in even case that the separation roller 43 is arranged such that the imaginary line formed by connecting the inlet and outlet of the nip portion coincides with the extension line S2 or lies above the extension line S2.

The entire disclosure of Japanese Patent Application No. Tokugan 2004-286657 filed on Sep. 30, 2004 including specification, claims, drawings and summary are incorporated herein by reference in its entirety.

What is claimed is:

1. An image forming apparatus, comprising:

a heating unit, a surface of the heating unit contacting a surface of a sheet of paper and fixing toner on the sheet of paper;

a pressure unit;

a pressure roller having a first diameter;

a separation roller having a second diameter smaller than the first diameter; and a first belt which connects the pressure roller and the separation roller to form the pressure unit, wherein the pressure roller presses the heating unit through the first belt to fix a toner image on the sheet of paper passing through a nip portion between the heating unit and the pressure unit, wherein the sheet of paper is conveyed by the first belt after being separated from the heating unit at an end of the nip portion, and the sheet of paper conveyed by the first belt is separated from the first belt at the separation roller at a position where the surface of the heating unit does not contact the sheet of paper, and wherein the separation roller is positioned such that a direction (S2) of the first belt from the pressure roller to the separation roller coincides with a tangent (S3) at an outlet of the nip portion to an imaginary circle which the pressure roller forms at the nip portion or is located on a pressure roller side with respect to the tangent (S3).

2. The image forming apparatus as claimed in claim 1, wherein the heating unit includes a heating roller, a fixing roller, and a second belt which connects the heating roller and the fixing roller, wherein the pressure roller contacts the fixing roller through the first and second belts.

3. The image forming apparatus as claimed in claim 2, wherein a hardness of the fixing roller is lower than a hardness of the pressure roller.

4. The image forming apparatus as claimed in claim 1, wherein a diameter of the separation roller is 10% to 80% of a diameter of the pressure roller.

5. The image forming apparatus as claimed in claim 1, wherein a diameter of the separation roller is 5 mm to 20 mm.

6. The image forming apparatus as claimed in claim 1, wherein the image forming apparatus is capable of forming a color image on both sides of the sheet of paper.

7. The image forming apparatus as claimed in claim 1, wherein the imaginary circle is a same shape as the pressure roller when the pressure roller is non-elastic.

8. An image forming apparatus, comprising:

a heating unit, a surface of the heating unit contacting a surface of a sheet of paper and fixing toner on the sheet of paper;

a pressure unit;

a pressure roller having a first diameter;

a separation roller having a second diameter smaller than the first diameter; and a first belt which connects the pressure roller and the separation roller to form the pressure unit, wherein the pressure roller presses the heating unit through the first belt to fix a toner image on the sheet of paper passing through a nip portion between the heating unit and the pressure unit, wherein the sheet of paper is conveyed by the first belt after being separated from the heating unit at an end of the nip portion, and the sheet of paper conveyed by the first belt is separated from the first belt at the separation roller at a position where the surface of the heating unit does not contact the sheet of paper, and wherein the separation roller is positioned such that a direction (S2) of the first belt from the pressure roller to the separation roller coincides with an imaginary line formed by connecting an inlet and an outlet of the nip portion or is located on a pressure roller side with respect to the imaginary line.

9. The image forming apparatus as claimed in claim 8, wherein the heating unit includes a heating roller, a fixing roller, and a second belt which connects the heating roller and the fixing roller, wherein the pressure roller contacts the fixing roller through the first and second belts.

10. The image forming apparatus as claimed in claim 9, wherein a hardness of the fixing roller is lower than a hardness of the pressure roller.

11. The image forming apparatus as claimed in claim 8, wherein a diameter of the separation roller is 10% to 80% of a diameter of the pressure roller.

12. The image forming apparatus as claimed in claim 8, wherein a diameter of the separation roller is 5 mm to 20 mm.

13. The image forming apparatus as claimed in claim 8, wherein the image forming apparatus is capable of forming a color image on both sides of the sheet of paper.

* * * * *